US006768250B2

(12) United States Patent
Cho

(10) Patent No.: US 6,768,250 B2
(45) Date of Patent: Jul. 27, 2004

(54) COLOR CATHODE-RAY TUBE

(75) Inventor: Hyun-Shik Cho, Seoul (KR)

(73) Assignee: LG Electronics Inc., Seoul (KR)

( * ) Notice: Subject to any disclaimer, the term of this patent is extended or adjusted under 35 U.S.C. 154(b) by 157 days.

(21) Appl. No.: 09/899,941

(22) Filed: Jul. 9, 2001

(65) Prior Publication Data

US 2002/0113538 A1 Aug. 22, 2002

(30) Foreign Application Priority Data

Dec. 22, 2000 (KR) ..... 2000-80113

(51) Int. Cl.[7] ..... H01J 29/80
(52) U.S. Cl. ..... 313/407; 313/402
(58) Field of Search ..... 313/402–408; 445/47

(56) References Cited

U.S. PATENT DOCUMENTS 4,191,909 A * 3/1980 Dougherty ..... 313/402
4,859,901 A * 8/1989 Thompson-Russell ..... 313/403
6,407,497 B1 * 6/2002 Lee et al. ..... 313/480

FOREIGN PATENT DOCUMENTS

FR 2576452 * 7/1986 ..... H01J/29/07

* cited by examiner

*Primary Examiner*—Ashok Patel
(74) *Attorney, Agent, or Firm*—Fleshner & Kim, LLP

(57) ABSTRACT

There is provided a color cathode-ray tube comprising a panel having a fluorescent plane formed on the inner face thereof, and a shadow mask arranged at the inner side of the panel having a predetermined distance therefrom, in which the shadow mask has an effective area in which electron beam passage holes are formed and a non-effective area surrounding the effective area, and at least one half etching line is formed at the non-effective portion of the shadow mask. Accordingly, shocks due to vibration of the cathode-ray tube are absorbed not to transmit to the shadow mask, improving the curved surface supporting strength of the shadow mask.

20 Claims, 6 Drawing Sheets

COLOR CATHODE-RAY TUBE

BACKGROUND OF THE INVENTION

1. Field of the Invention

The present invention relates to a color cathode-ray tube and, more particularly, to a color cathode-ray tube in which a half etching line is formed surrounding the effective area of a shadow mask in order to increase curved surface supporting strength of the shadow mask to allow the shadow mask to endure shocks.

2. Description of the Related Art

A conventional color cathode-ray tube is described below with reference to FIG. 1. The conventional color cathode-ray tube is constructed in a manner that a front glass called a panel 1 and a back glass called a funnel 2 are combined with each other through a frit glass. The cathode-ray tube includes a fluorescent plane 4 emitting light, formed on the inner surface of the panel, an electron gun 14 serving as a source of electron beams (6) for making the fluorescent plane 4 generate light, a shadow mask 3 for selecting colors to allow a predetermined fluorescent substance to emit light, and a frame 7 for supporting the shadow mask 3. A spring 8 for combining the frame with a stud pin of the panel 1 is attached to the frame. An inner shield 9 for shielding the cathode-ray tube to allow it not to severely affect by external magnetic field during its operation is also attached to the frame.

In the operation of the color cathode-ray tube, the electron beams 6 emitted from the electron gun 14 set inside a neck 15 of the funnel 2 strike the fluorescent plane 4 formed on the inner face of the panel 1 according to a positive voltage applied to the cathode-ray tube. Here, the electron beams 6 are deflected by a deflection yoke 5 upward, downward, left and right before reaching the fluorescent plane, to form an image. There is a magnet 10 with a 2-pole, 4-pole or 6-pole for correcting the traveling path of the electron beams 6 to allow them to accurately strike a predetermined portion of the fluorescent plane, which prevents color purity from being deteriorated.

The general cathode-ray tube may be easily exploded due to an external shock because it has a high degree of vacuum state therein. To prevent this, a reinforcing band 11 is attached to the skirt of the panel 1 to disperse the stress of the cathode-ray tube with the high-level vacuum state to secure shock-resistance.

In the general cathode-ray tube, however, red, green and blue electron beams that have passed through electron beam passage holes of the shadow mask are needed to be exactly landed on the three-color fluorescent plane in order to display images with high resolution on a fluorescent screen. This also requires that a gap (q-value) between the inner side of an effective area of the panel and an effective area of the shadow mask be maintained within a predetermined acceptance range.

For recent color cathode-ray tubes, flat panels have been proposed in order to improve visibility. One type of flat panel cathode-ray tube is shown in FIG. 2, with reference to the same reference numbers illustrated in FIG. 1. This flat panel has the outer surface that is also flat and the inner surface having curvature smaller than that of the effective area of the conventional color cathode-ray tube. This requires the shadow mask applied to the color cathode-ray tube having the panel whose effective area is flat to have smaller curvature, resulting in a decrease in curved surface supporting strength of the effective area of the shadow mask. In general, the shadow mask for the color cathode-ray tube is partially deformed when it has a shock above a predetermined strength, deteriorating color purity.

SUMMARY OF TILE INVENTION

It is, therefore, an object of the present invention to provide a color cathode-ray tube for increasing the curved surface supporting strength of the shadow mask and mitigating shocks applied to the shadow mask, to prevent deterioration of color purity.

To accomplish the object of the present invention, there is provided a color cathode-ray tube comprising a panel having a fluorescent plane formed on the inner surface thereof, and a shadow mask arranged at the inner side of the panel, having a predetermined distance therefrom, in which the shadow mask has an effective area in which electron beam passage holes are formed and a non-effective area surrounding the effective area, and at least one half etching line is formed at the non-effective area of the shadow mask.

The half etching line may be formed to be extended toward at least one of the shorter side and longer side of the shadow mask, or formed between a bent portion and a portion attached to the frame at the skirt of the shadow mask.

The half etching line may be formed on each of both sides of the non-effective area. In this case, it is preferable that the half etching lines are alternately formed on both sides of the non-effective area.

The half etching line has a rectangular shape surrounding the effective area. The radius of curvature of the corner of the half etching line is 0.8–3 mm, preferably.

The half etching line is preferably applied to a shadow mask of a flat color cathode-ray tube, whose outer surface is substantially flat and whose inner surface has predetermined curvature.

It is preferable that the distance between the effective area and the half etching lines corresponds to 100–200 $\mu$m, the width of the half etching line is 50–100 $\mu$m, there are at least two half etch lines, the distance between the two half etching lines corresponding to 100–150 $\mu$m, and the etched depth of the half etching line corresponds to 15–45 $\mu$m.

DETAILED DESCRIPTION OF THE PREFERRED EMBODIMENT

Reference will now be made in detail to the preferred embodiments of the present invention, examples of which are illustrated in the accompanying drawings.

Figure 1:
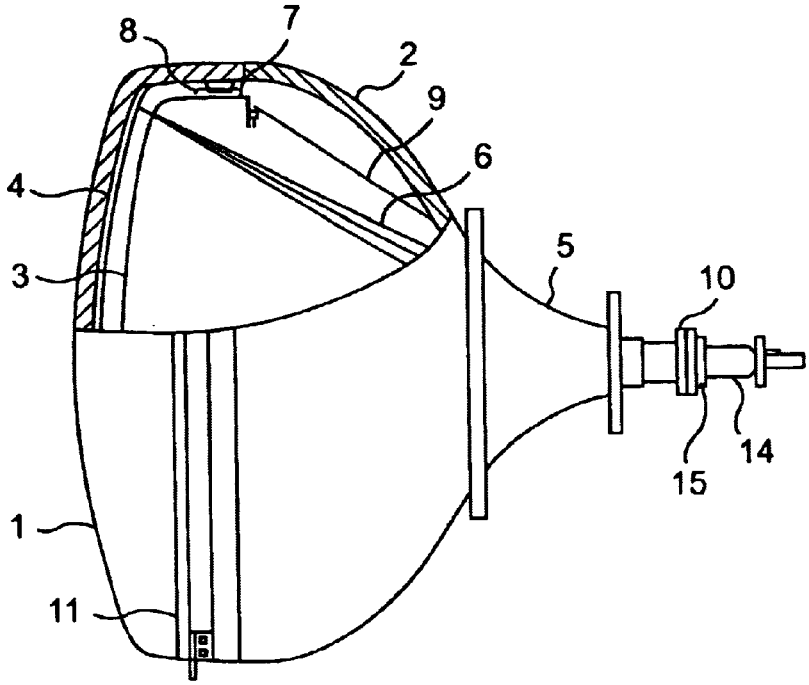
FIG. 1 PRIOR ART
FIG. 1 briefly shows the structure of a conventional cathode-ray tube.
Figure 2:
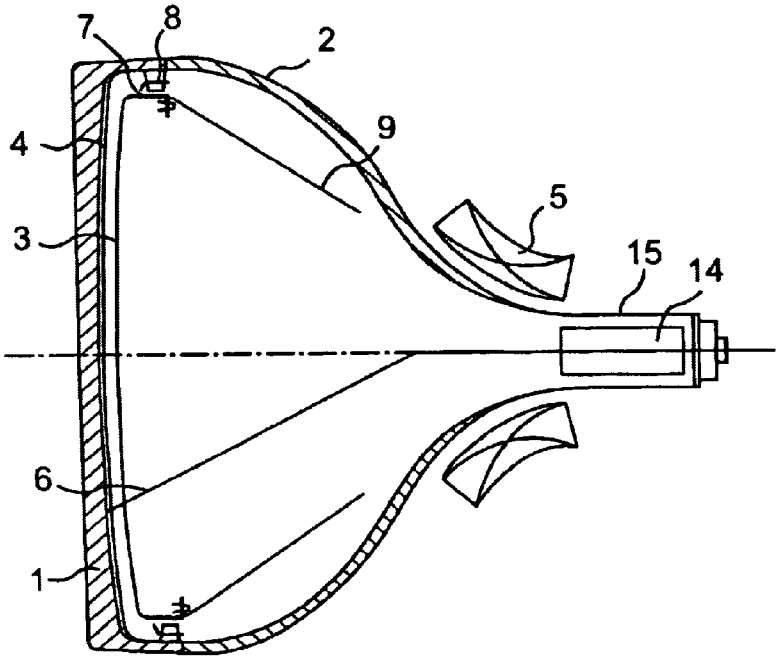
FIG. 2 PRIOR ART
FIG. 2 briefly shows the structure of a conventional flat cathode-ray tube.
Figure 3:
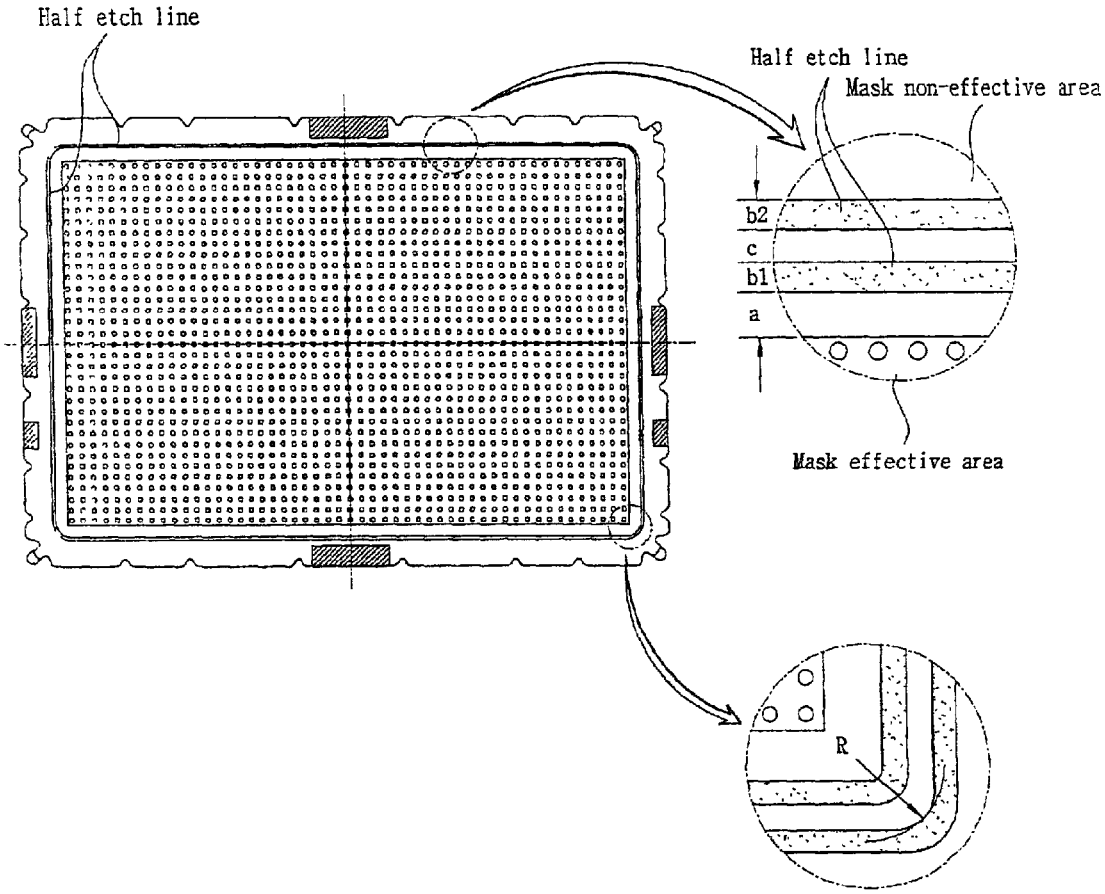
FIG. 3 shows the structure of a half etching line of a shadow mask according to the present invention.

FIG. 3 shows the structure of a shadow mask according to the present invention. The shadow mask has an effective area 100 in which a plurality of passage holes through which electron beams pass are formed, and a non-effective area 200 surrounding the effective area. In the non-effective area 200, two half etching lines according to the present invention are arranged to be a rectangular shape surrounding the effective area 100. The half etching line preferably has the radius of curvature R of 0.8–3 mm at the corner of the shadow mask. The effective area may be deformed in molding of the shadow mask when the radius of curvature is excessively large. On the other hand, fabrication of the half etching line according to an etching process is difficult to be controlled when the radius of curvature of the rectangular half etching line is too small. It is preferable that the half etching lines are formed on the surface of the shadow mask opposite to the fluorescent plane, that is, on the surface toward the electron gun side in order to prevent deformation of the shadow mask during molding of the shadow mask or maintain the supporting strength. But, it is also possible to form the half etching lines on the surface toward the fluorescent plane.

Figure 4:
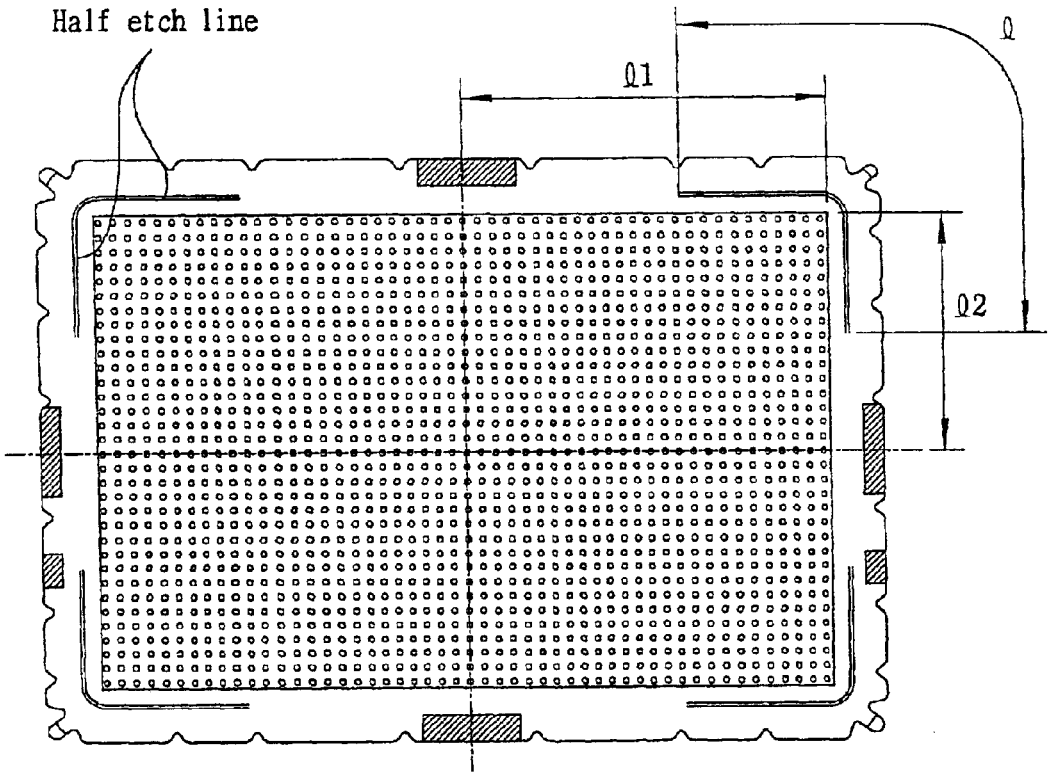
FIG. 4 shows the half etching line formed at the corner according to the present invention.

FIG. 4 shows the half etching lines that are formed at the corners of the shadow mask according to the present invention. It is possible to obtain sufficient effect even when the half etching lines are formed only at the corners because deformation force is concentrated on the corners in case of a shock due to dropping of the cathode-ray tube. Here, the length (l) of the half etching line formed at the corner should be set to correspond to above 60% of half the longer side (l1) or half the shorter side (l2) of the effective area of the shadow mask in order to attain preferable effect.

Figure 5:
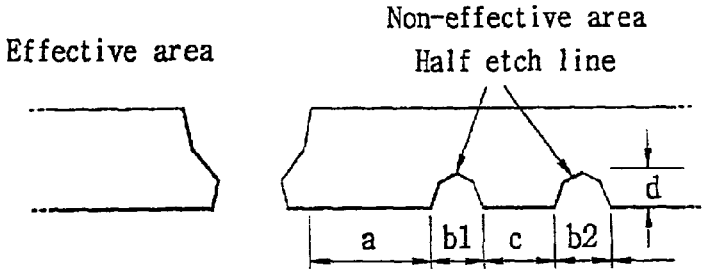
FIG. 5 shows the structure of the half etching line when the shadow mask of the present invention is cut in the direction of thickness thereof.

Referring to FIG. 5, it is preferable that the distance(a) between the effective area 100 and the half etching lines corresponds to 100–200 $\mu$m, the widths (b1 and b2) of the half etching lines are 50–100 $\mu$m, and the distance (c) between the two half etching lines is 100–150 $\mu$m that corresponds from the thickness of the shadow mask to twice the thickness thereof. In addition, the depth (d) of the half etching line is preferably designed to be in the range of 15 $\mu$m to 45 $\mu$m, corresponding to 10–35% of the thickness of the shadow mask. Vibration absorption effect is deteriorated when the depth of the half etching line is less than 10% of the thickness of the shadow mask. On the other hand, there is quite a possibility of generation of break when the shadow mask is molded if the thickness of the half etching line is above 35% of the thickness of the shadow mask.

The above-described effect the present invention intends to attain can be obtained even when the two half etching lines are formed at least one of the longer side, shorter side and corner of the shadow mask or more than three half etching lines are formed.

Figure 6:
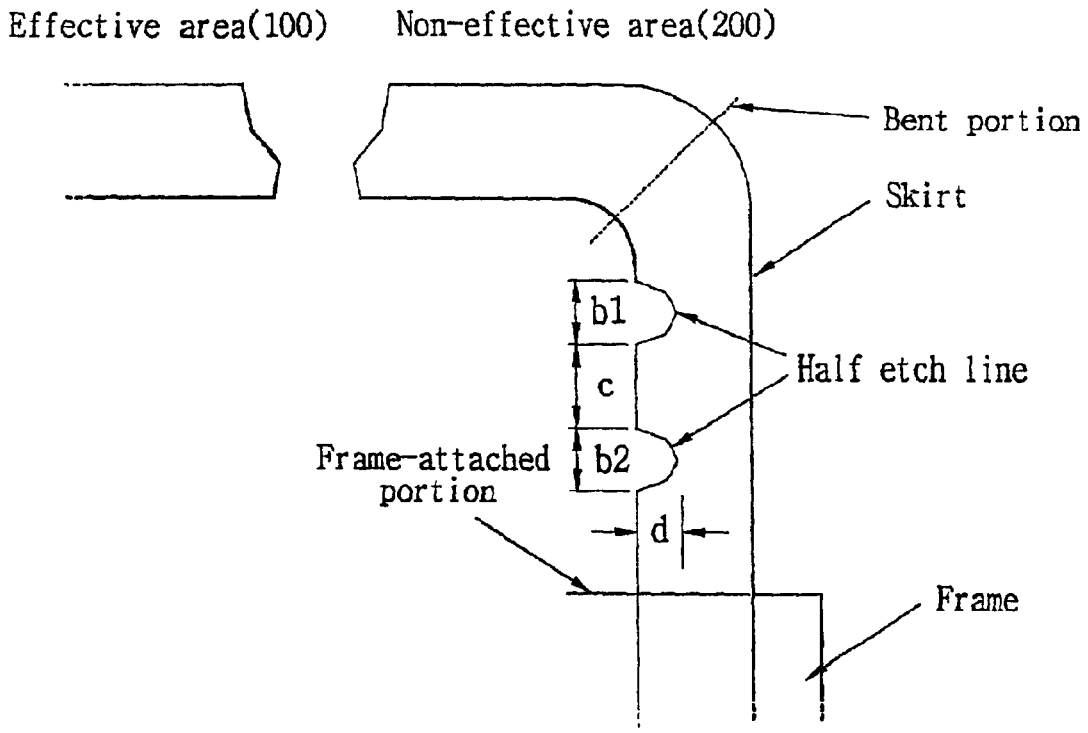
FIG. 6 shows another embodiment of the present invention.

FIG. 6 illustrates another embodiment of the present invention. As shown in FIG. 6, a part of the non-effective area 200 of the shadow mask accomplished for being attached to the frame is bent to have the skirt. Here, the half etching lines can be formed to be placed between the portion to which the frame is attached and the bent portion.

Figure 7:
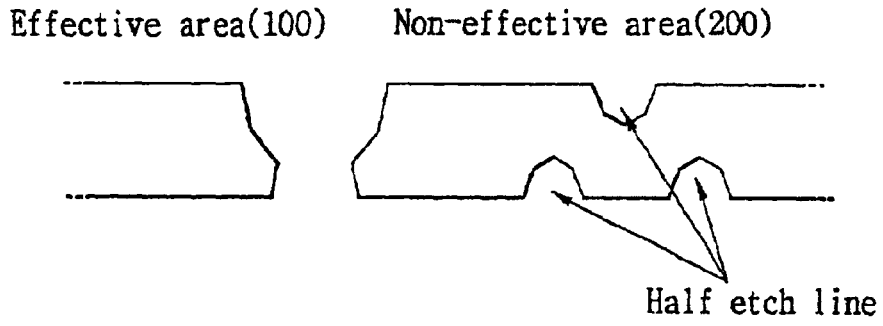
FIG. 7 shows another embodiment of the present invention.

FIG. 7 illustrates another embodiment of the present invention in which the half etching lines are formed on both sides of the non-effective area. Here, these half etching lines should be alternately formed in order to maintain mechanical strength.

Figure 8:
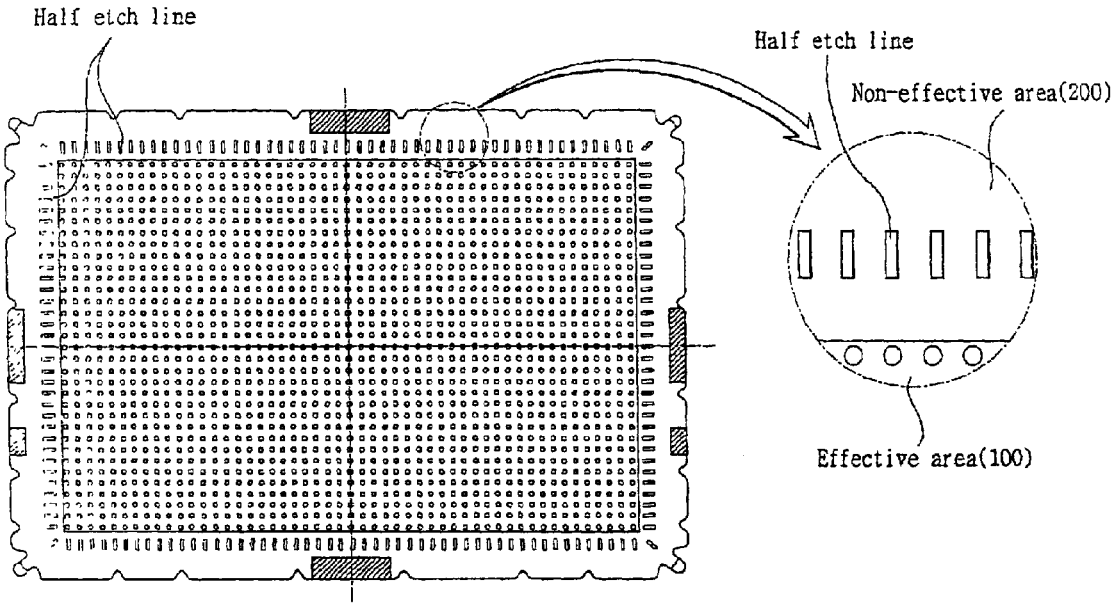
FIG. 8 shows another embodiment of the present invention.

FIG. 8 illustrates a modified embodiment of the present invention in which a plurality of half etching lines are formed, being extended to the longer side and shorter side of the shadow mask. Similarly to the embodiment of FIG. 3, it is preferable that the distance between the effective area 100 and the half etching lines corresponds to 100–200 $\mu$m, the width of the half etching line is 50–100 $\mu$m, the distance between the half etching lines is 100–150 $\mu$m, and the depth of each half etching line is designed to be in the range of 15 $\mu$m to 45 $\mu$m.

Figure 9:
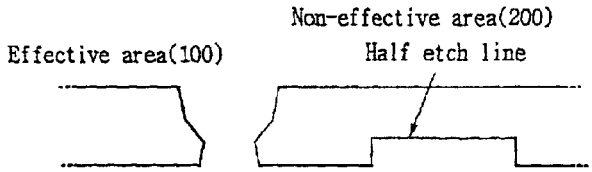
FIG. 9 shows the structure of the half etching line when the half etching line of the embodiment of FIG. 8 is cut in the direction of thickness of the shadow mask.
Figure 10:
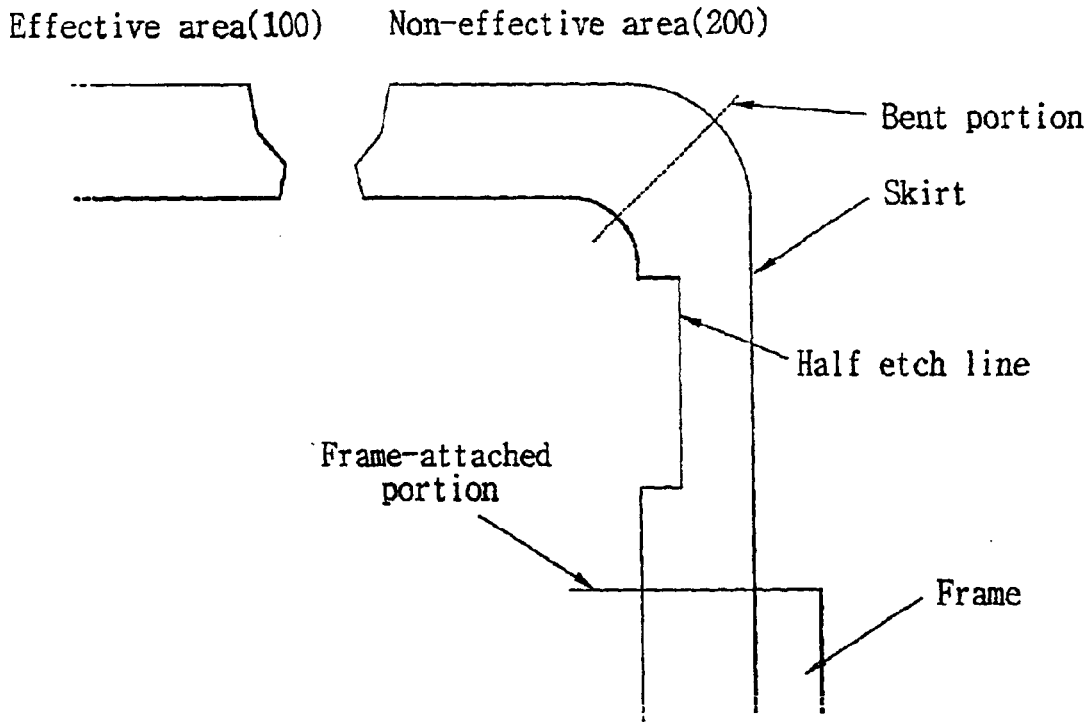
FIG. 10 shows a modified structure of the half etching line described in the embodiment of FIG. 8.

FIG. 9 illustrates the partial cross section of the half etching line shown in FIG. 8 when it is cut in the direction of thickness of the shadow mask. FIG. 10 illustrates that the half etching lines are formed between the bent portion and the portion to which the frame is attached at the skirt of the shadow mask, similarly to the embodiment of FIG. 6. In this case, the half etching lines are extended toward the panel, as distinguished from the embodiment of FIG. 6 where the half etching lines are extended perpendicular to the panel.

Figure 11:
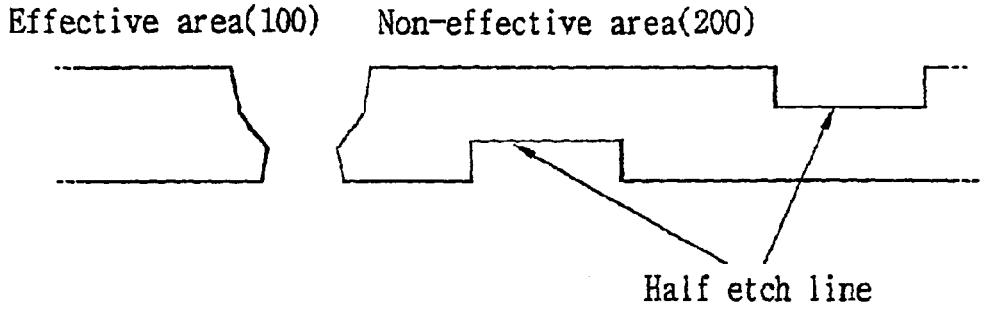
FIG. 11 shows another modified example of the embodiment of FIG. 8.

FIG. 11 illustrates an embodiment of the present invention in which the half etching lines are formed on both sides of the non-effective area 200, similar to the embodiment shown in FIG. 7. In this case, the half etching lines are extended in parallel with the surface of the shadow mask.

When the half etching lines of the present invention are applied to the shadow mask of a flat color cathode-ray tube, whose outer surface is substantially flat and whose inner surface has curvature, it is possible to effectively improve hauling of the flat shadow mask that generally has weak curved surface supporting strength.

As described above, the half etching lines formed at the non-effective area 200 can absorb shocks applied to the shadow mask through the frame, resulting in improvement of curved surface supporting strength of the shadow mask, preventing the hauling.

The inventor carried out dropping experiments for a 17" CDT employing the shadow mask having the half etching lines of the present invention and a conventional 17" CDT using a general shadow mask. The following table 1 represents the experimental result.

TABLE 1

| | Product of present invention | Conventional product |
|---|---|---|
| 1 | 38.7 G | 35.6 G |
| 2 | 39.4 G | 35.6 G |
| 3 | 39.4 G | 35.6 G |
| 4 | 38.9 G | 35.9 G |
| 5 | 39.4 G | 35.5 G |

The values shown in the table 1 correspond to impact values of samples obtained by dropping the samples while varying the height of them. These values indicate limit values (force due to gravity) below which the shadow mask is not deformed by shocks. In other words, color purity is varied in case of exceeding the limit values. The larger these limit values, the higher the curved surface supporting strength of the shadow mask. Thus, the shadow mask can endure shocks when it has a larger limit value. It can be confirmed the excellent effect of the invention from the result, shown in the table 1, that the samples to which the half etching lines of the present invention are applied have the limit values higher than those of the conventional products by about 4 G (gravitation).

According to the present invention, as described above, the products to which the present invention is applied endure the drop test more satisfactorily than the conventional color cathode-ray tube. Furthermore, the supporting strength of the shadow mask can be increased even when its material is the same as that of the conventional one. Moreover, the present invention improves hauling in the cathode-ray tube.

Although specific embodiments including the preferred embodiment have been illustrated and described, it will be obvious to those skilled in the art that various modifications may be made without departing from the spirit and scope of the present invention, which is intended to be limited solely by the appended claims.

What is claimed is:

1. A color cathode-ray tube comprising a shadow mask, wherein said shadow mask has an effective area in which electron beam passage holes are formed and a non-effective area surrounding said effective area, and at least one half etching line is formed at the non-effective area of the shadow mask, and wherein at least one half etching line comprises a portion that extends a distance of a length and a width of the effective area and the at least one half etching line is located in a same plane or a plane parallel to the effective area.

2. The color cathode-ray tube as claimed in claim 1, wherein the half etching line is formed on the surface of the shadow mask, opposite to the fluorescent plane and the at least one half etching line increases a supporting strength of the shadow mask.

3. The color cathode-ray tube as claimed in claim 1, wherein the half etching line is formed to extend toward the shorter side, longer side and corner of the shadow mask and the at least one half etching line increases a supporting strength of the shadow mask.

4. The color cathode-ray tube as claimed in claim 1, wherein the non-effective area is bent to have a skirt attached to a frame, and the half etching line is placed between the bent portion and the portion attached to the frame at the skirt and the at least one half etching line increases a supporting strength of the shadow mask.

5. The color cathode-ray tube as claimed in claim 1, wherein the half etching line is formed with a radius of curvature of a corner of the half etching line is about 0.8–3 mm.

6. The color cathode-ray tube as claimed in claim 1, wherein the half etching lines are formed on only one surface thereof and the at least one half etching line increases a supporting strength of the shadow mask.

7. The color cathode-ray tube as claimed in claim 1, wherein the half etching line has a rectangular shape surrounding the effective area and the at least one half etching line increases a supporting strength of the shadow mask.

8. The color cathode-ray tube as claimed in claim 1, wherein the panel is a flat type whose outer surface is substantially flat and whose inner surface has a predetermined curvature and the at least one half etching line increases a supporting strength of the shadow mask.

9. The color cathode-ray tube as claimed in claim 1, wherein the distance between the effective area and the half etching lines corresponds to 100–200 $\mu$m and the at least one half etching line increases a supporting strength of the shadow mask.

10. The color cathode-ray tube as claimed in claim 1, wherein the width of the half etching line is 50–100 $\mu$m and the at least one half etching line increases a supporting strength of the shadow mask.

11. The color cathode-ray tube as claimed in claim 1, wherein there are at least two half etch lines, and the at least two half etching lines align with at least two corners of the shadow mask.

12. The color cathode-ray tube as claimed in claim 1, wherein the at least one half etching line is rectangular shaped in depth and increases a supporting strength of the shadow mask.

13. The color cathode-ray tube as claimed in claim 1, wherein the half etching line surrounds a corner of the shadow mask and the at least one half etching line increases a supporting strength of the shadow mask.

14. The color cathode-ray tube as claimed in claim 1, wherein the at least one half etching line extends perpendicular to an edge of the effective area closest to the at least one half etching line.

15. The color cathode-ray tube as claimed in claim 3, wherein the radius of curvature of the corner of the half etching line is 0.8–3 mm and the at least one half etching line increases a supporting strength of the shadow mask.

16. The color cathode-ray tube as claimed in claim 1, wherein the length (l) of the half etching line surrounding the corner of the shadow mask is above 60% of half the longer side (l1) or half the shorter side (l2) of the effective area of the shadow mask and the at least one half etching line increases a supporting strength of the shadow mask.

17. A shadow mask having a flat shape for a display panel comprising:

an effective area having beam passage holes; and a non-effective area adjacent and parallel to said effective area, wherein at least one groove formed on the non-effective area which is parallel to the effective area extends a prescribed distance parallel to at least a one of a length and a width of the effective area and wherein said at least one groove is formed on only one flat side of the shadow mask.

18. The shadow mask as claimed in claim 17, wherein a cathode ray tube enclads the shadow mask and wherein said at least one groove extends in both a length and a width of the effective area.

19. A color cathode-ray tube comprising a shadow mask, with an effective area in which electron beam passage holes are formed and a non-effective area surrounding said effective area, and at least one half etching line is formed at the non-effective area of the shadow mask, wherein said at least one half etching line comprises a half etching line that extends a distance perpendicular to and from an effective area and non-effective are intersection line at least one of a length and a width of the effective area and the at least one half etching line is located in a same plane or a plane parallel to the effective area and wherein the etched depth of the half etching line corresponds to 15–45 m and the at least one half etching line increases a supporting strength of the shadow mask.

20. The color cathode-ray tube of claim 19, wherein said at least one half etching line comprises at least two half etching lines, wherein a first half etching line extends from a length intersection line between said effective area and said non-effective area, and wherein a second half etching line extends from a width intersection line between said effective area and said non-effective area.

* * * * *